US007121284B2

(12) United States Patent
Gueret

(10) Patent No.: US 7,121,284 B2
(45) Date of Patent: Oct. 17, 2006

(54) PRODUCT APPLICATOR FOR EYELASHES AND/OR EYEBROWS, AND METHOD OF PRODUCT APPLICATION

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 359 days.

(21) Appl. No.: 10/277,670

(22) Filed: Oct. 23, 2002

(65) Prior Publication Data

US 2003/0089379 A1 May 15, 2003

(30) Foreign Application Priority Data

Oct. 23, 2001 (FR) ..... 01 13669

(51) Int. Cl.
*A45D 40/26* (2006.01)

(52) U.S. Cl. ..... 132/218

(58) Field of Classification Search ..... 132/218, 132/320, 317, 313, 216, 217, 219, 126, 137, 132/139, 140, 150; 401/126, 122, 129; 15/167.1, 167.2, 207.2
See application file for complete search history.

(56) References Cited

U.S. PATENT DOCUMENTS 466,496 A * 1/1892 Heysinger ..... 132/137
1,094,013 A * 4/1914 Peterson ..... 132/137
1,892,749 A * 1/1933 Philaja ..... 132/137
1,989,185 A * 1/1935 Clein ..... 132/137
3,343,551 A * 9/1967 Anderson ..... 132/218
3,763,870 A * 10/1973 Montgomery et al. ..... 132/218
3,892,248 A * 7/1975 Kingsford ..... 132/218
3,896,823 A * 7/1975 Spatz ..... 132/218
3,921,650 A 11/1975 Montgomery
3,930,280 A 1/1976 Vasas
3,935,611 A * 2/1976 Locher ..... 15/160
4,291,432 A * 9/1981 Cogswell ..... 15/160
4,365,642 A * 12/1982 Costa ..... 132/218
4,527,575 A 7/1985 Vasas
4,635,659 A * 1/1987 Spatz ..... 132/218
5,007,442 A 4/1991 Hirzel
5,137,038 A * 8/1992 Kingsford ..... 132/218

(Continued)

FOREIGN PATENT DOCUMENTS

DE 25 59 273 7/1977

(Continued)

OTHER PUBLICATIONS

English language Derwent Abstract of DE 25 59 273, Jul. 7, 1977.

(Continued)

*Primary Examiner*—Eduardo C. Robert
*Assistant Examiner*—David Comstock
(74) *Attorney, Agent, or Firm*—Finnegan, Henderson, Farabow, Garrett & Dunner, LLP

(57) ABSTRACT

An applicator includes an applicator member having an applicator portion. The applicator portion comprises a first succession of teeth and a second succession of teeth substantially opposite the first succession of teeth. At least a plurality of the teeth of the first succession have free ends situated along a first line having a generally concave side facing away from the applicator portion, and at least a plurality of the teeth of the second succession have free ends situated along a second line having a generally convex side facing away from the applicator portion. The applicator portion defines an envelope surface, the envelope surface having, at least one point along its length, a cross-section being generally elongate in shape and having a major axis substantially parallel to a straight line joining together the first line and the second line.

53 Claims, 5 Drawing Sheets

U.S. PATENT DOCUMENTS

| | | | | | |
|---|---|---|---|---|---|
| 5,224,787 | A | * | 7/1993 | Vasas | 401/119 |
| 5,816,728 | A | * | 10/1998 | Nardolillo et al. | 401/126 |
| 5,853,010 | A | * | 12/1998 | Suh | 132/217 |
| 5,934,292 | A | | 8/1999 | Gueret | |
| 5,937,870 | A | | 8/1999 | Gueret | |
| 5,951,185 | A | | 9/1999 | Kingsford et al. | |
| 6,237,609 | B1 | | 5/2001 | Vasas | |
| 6,343,607 | B1 | | 2/2002 | Gueret | |
| 6,412,496 | B1 | | 7/2002 | Gueret | |
| 6,446,637 | B1 | | 9/2002 | Gueret | |
| 2002/0020424 | A1 | | 2/2002 | Gueret | |

FOREIGN PATENT DOCUMENTS

| | | |
|---|---|---|
| EP | 0 038 524 | 10/1981 |
| EP | 0 204 466 | 12/1986 |
| EP | 0 474 934 | 3/1992 |
| EP | 1 053 695 | 11/2000 |
| EP | 1 070 465 | 1/2001 |
| EP | 1 070 466 | 1/2001 |
| EP | 1 070 467 | 1/2001 |
| EP | 1 070 468 | 1/2001 |
| FR | 2 564 712 | 11/1985 |
| FR | 2 793 663 | 11/2000 |
| GB | 2 146 520 | 4/1985 |
| JP | 58-88912 (U) | 6/1983 |
| JP | 7-47013 | 2/1995 |
| WO | WO 96/29905 | 10/1996 |
| WO | WO 01/05272 | 1/2001 |
| WO | WO 01/05273 | 1/2001 |

OTHER PUBLICATIONS

English language Derwent Abstract of EP 0 038 524, Oct. 28, 1981.
English language Derwent Abstract of EP 1 053 695, Nov. 22, 2000.
English language Derwent Abstract of EP 1 070 465, Jan. 24, 2001.
English language Derwent Abstract of FR 2 793 663, Nov. 24, 2000.
English-language Abstract of JP 7-47013.

* cited by examiner

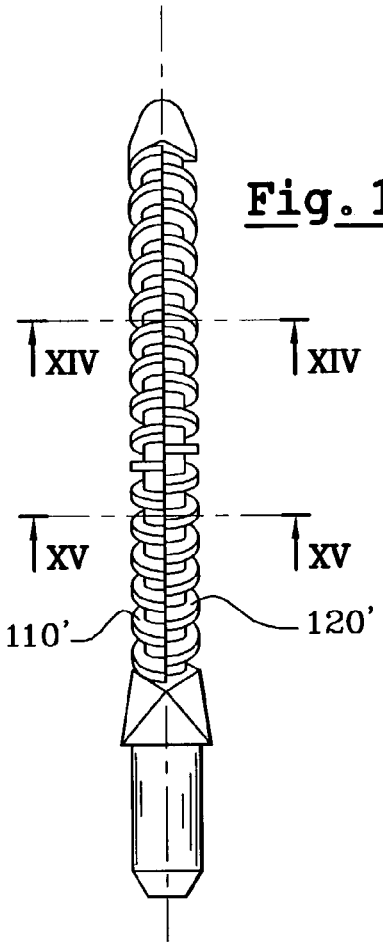
Fig. 13
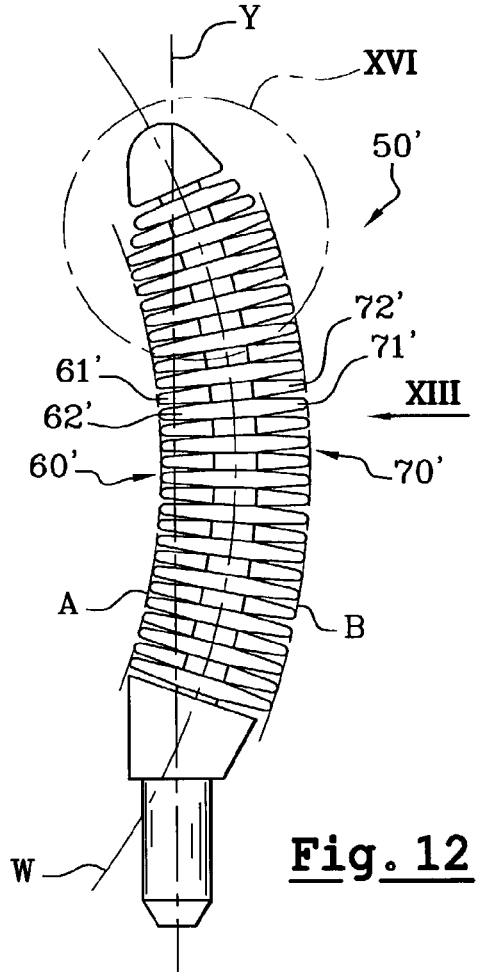
Fig. 12
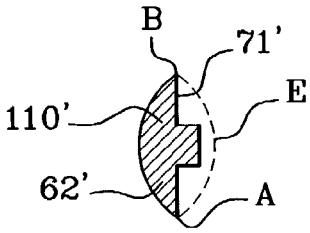
Fig. 15
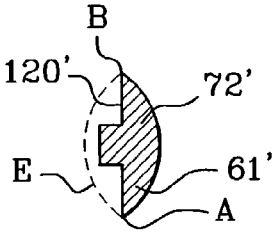
Fig. 14
Fig. 16
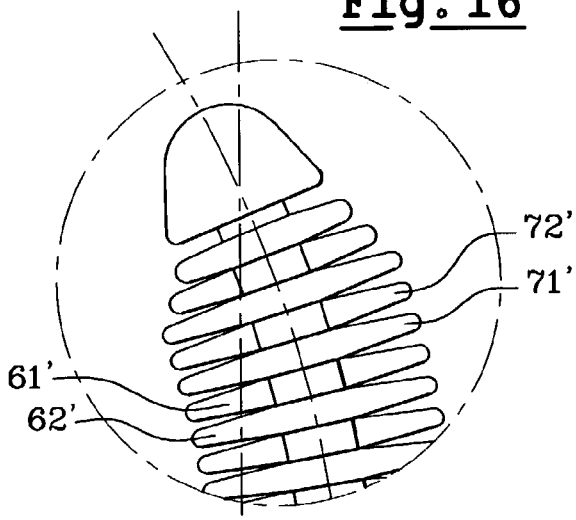

PRODUCT APPLICATOR FOR EYELASHES AND/OR EYEBROWS, AND METHOD OF PRODUCT APPLICATION

The present invention relates, in general, to applicators and methods of using applicators for applying a substance. For example, the applicator could be used for applying a substance, such as, for example, a cosmetic product, to eyelashes and eyebrows.

BACKGROUND

European patent application EP 1 070 466 discloses an applicator member comprising a succession of projecting elements for applying a substance to the eyelashes and/or the eyebrows. French patent FR 2 793 663 discloses an applicator member made by injection molding a plastics material, wherein a core of the member is elastically deformable and takes up a curved shape when at rest. The following publications describe other examples of applicator members: EP 1 070 465, EP 1 070 467, EP 1 070 468, EP 237 630, EP 204 466, EP 474 934, EP 038 524, DE 2 559 273, WO 01/05273, WO 01/05272, U.S. Pat. No. 5,007,442, U.S. Pat. No. 3,892,248, U.S. Pat. No. 3,930,280, U.S. Pat. No. 5,951,185, and U.S. Pat. No. 3,921,650, FR 2 564 712, and WO 97/28719.

There exists a need for a product application device for the eyelashes and/or the eyebrows that is capable of being used, if the user so desires, in a manner that is satisfactory.

SUMMARY

In the following description, certain aspects and embodiments will become evident. It should be understood that the invention, in its broadest sense, could be practiced without having one or more features of these aspects and embodiments. It should also be understood that these aspects and embodiments are merely exemplary.

One aspect of the present invention relates to an applicator comprising an applicator member including an applicator portion. The applicator portion comprises a first succession of teeth and a second succession of teeth substantially opposite the first succession of teeth. At least a plurality of the teeth of the first succession have free ends situated along a first line having a generally concave side facing away from the applicator portion and at least a plurality of the teeth of the second succession have free ends situated along a second line having a generally convex side facing away from the applicator portion. The applicator portion defines an envelope surface, the envelope surface having, at at least one point along its length, a cross-section being generally elongate in shape and having a major axis substantially parallel to a straight line joining together the first line and the second line.

As used herein, the term "teeth" should be construed as being a structural arrangement other than bristles. For example, "teeth" are not bristles held by a twisted wire core having branches twisted together to hold bristles. In some embodiments, the teeth may be defined by a single, unitary piece of material (e.g., molded material) but other arrangements are possible, such as where individual teeth or individual teeth groups are connected to a remainder of the applicator.

As also used herein, the term "envelope surface" should be construed as being a surface defined by the outermost surface portions of the applicator portion. In some embodiments, the envelope surface may be defined by the free ends of the teeth and outermost side portions of the teeth. In other embodiments, the envelope surface may be defined by the free ends of the teeth, the outermost side portions of the teeth, and outermost surface portions of a core portion from which the teeth extend.

The term major axis "substantially parallel" to a straight line should be understood as meaning that the angle between the major axis and the straight line is relatively small. For example, the angle may be less than or equal to 45°, or even 30°.

In a further aspect of the present invention, a spacing, measured along the first line, between the free ends of two consecutive teeth of the first succession is less than or equal to a spacing, measured along the second line, between the free ends of two consecutive teeth of the second succession.

In another aspect of the present invention, the first and second lines may be spaced apart by a distance having a maximum value ranging from about 5 mm to about 9 mm. Alternatively, the first and second lines may be spaced apart by a distance having a maximum value ranging from about 6 mm to about 8 mm.

In yet another aspect of the present invention, the envelope surface of the applicator portion may have a cross-section that is substantially lenticular at the at least one point along its length.

In a further aspect, the applicator portion may have a longitudinal axis that is contained entirely in a single plane. Alternatively, the applicator portion may have longitudinal axis not entirely contained in a single plane.

In another aspect, the applicator member may be made out of a non-elastomeric plastic material.

In another aspect, the applicator may lack a twisted wire core formed of twisted wire branches.

In another aspect, the applicator portion lacks teeth extending in substantially all radial directions (e.g., the teeth do not extend in substantially all directions like bristles extending from a twisted wire core of a bristled mascara brush).

In yet another aspect of the present invention, the size of the teeth as measured along the axis of each tooth may decrease in a direction approaching a distal portion of the applicator portion.

In another aspect of the present invention, the size of the teeth of the first succession, as measured along a tooth axis, may be greater than or equal to about 0.5 millimeters (mm), about 1 mm, about 2 mm, or about 3 mm.

In yet another aspect of the present invention, the size of the teeth of the second succession, as measured along a tooth axis, may be greater than or equal to about 0.5 mm, about 1 mm, about 2 mm, or about 3 mm.

In a further aspect, the applicator member may be made of a plastic material having hardness greater than or equal to about 60 on the Shore A scale or in the vicinity of 80 to 90 on the Shore D scale.

In another aspect, the teeth of the first and second successions may have axes that extend along radii projecting from a common center.

In a further aspect, at least one tooth of the first succession and at least one tooth associated with the second succession may have axes that are substantially parallel.

In another aspect, at least a plurality of teeth of at least one of the first succession and the second succession may have bases disposed in a staggered configuration. In a further aspect, at least a plurality of teeth of both of the first and second succession have bases disposed in a staggered configuration. In some embodiments, this may enable cavities to be formed between the teeth for increasing the quantity of substance loaded onto the applicator.

In another aspect, when the applicator portion is observed from a side, at least some of the teeth may form grooves that are V-shaped.

In another aspect, the length of the first and/or second succession may range from about 15 mm to about 30 mm.

In still another aspect, the height of the teeth of the first and/or second succession may range from about 2 mm to about 4 mm.

In yet another aspect, the number of teeth of the first and/or second succession ranges from about 20 to about 40.

In another aspect, the applicator portion has a longitudinal axis having at least two curved portions and each of the at least two curved portions curve in differing directions.

In still another aspect, the applicator portion includes a core having a substantially rectangular cross-section and each of the teeth of the first and second succession are formed on the core.

In yet another aspect, there is an applicator system. The applicator system comprises an applicator and a receptacle configured to contain a substance to be applied by the applicator.

In another aspect, the system further comprises a cosmetic product contained in the receptacle. For example, the cosmetic product may be a makeup product, such as mascara or any other makeup.

In yet another aspect, the system further comprises an elastically deformable wiper associated with the receptacle.

In yet another aspect, the wiper has an opening configured to allow the applicator member to pass therethrough while being withdrawn from the receptacle. The wiper may be configured so that while the applicator member is passing through the wiper the opening changes shape by being lengthened in a direction substantially parallel to the major axis by an elongation factor that is greater than or equal to about 1.5. (As used herein, the elongation factor is a ratio of the dimension of the wiper opening with the applicator member being present in the opening to the dimension of the wiper opening without the applicator element being present in the wiper opening.) Alternatively, the elongation factor may be greater than or equal to about 2 or about 2.5. In some embodiments, such elongation factors may provide the wiper with satisfactory wiping of the applicator member. It should be understood, however, that alternative arrangements are possible, such as wipers having openings configured to close substantially completely in the absence of the applicator member.

In a further aspect, in the absence of the applicator member, the opening may be substantially circular in shape.

In another aspect, the applicator comprises a rod having a substantially circular cross-section and the applicator member may be fixed to an end of the rod. The diameter of the rod (when the rod cross-section is substantially circular) may be greater than the diameter of the opening (when the opening is substantially circular) in the absence of the applicator.

In yet another aspect, in the absence of the applicator, the opening may have a diameter that is less than or equal to about 3 mm.

In another aspect, in the absence of the applicator, the diameter of the opening (when the opening is substantially circular) may be less than or equal to a smallest cross-section of the envelope surface of the applicator portion.

In another aspect, the wiper may be made of elastomer.

In yet another aspect, the wiper may have a wiping lip having a free end that defines the opening.

In still another aspect, the applicator member may have a proximal portion and a distal portion and the applicator portion may be situated between the proximal portion and the distal portion. The proximal and distal portions may be configured to make it easier to pass the applicator member through the wiper.

In another aspect, the applicator comprises a rod and an assembly portion to fix the applicator member to the rod.

In a further aspect, the applicator member extends along a longitudinal axis of curvature such that a distal portion of the applicator member and a proximal portion of the applicator member are intersected by a straight line substantially parallel to a longitudinal axis of the assembly portion.

In another aspect, a size of each of the teeth of the first and second succession, as measured along a tooth axis, decreases as the teeth of the first succession and the second succession near a distal portion of the applicator member.

In still another aspect, there is a method of applying a cosmetic product. The method comprises loading a cosmetic product onto an applicator member comprising an applicator portion. The applicator portion comprises a first succession of teeth and a second succession of teeth substantially opposite the first succession of teeth. At least a plurality of the teeth of the first succession have free ends situated along a first line having a generally concave side facing away from the applicator portion and at least a plurality of the teeth of the second succession have free ends situated along a second line having a generally convex side facing away from the applicator portion. The method further includes applying the cosmetic product to at least eyelashes using at least a plurality of teeth of the first succession and applying the cosmetic product to at least eyebrows using at least a plurality of teeth of the second succession.

In yet another aspect, the cosmetic product comprises makeup.

In a further aspect, a method of applying a cosmetic product comprises providing an applicator, loading a cosmetic product onto the applicator member, and applying the cosmetic product to at least one external body portion using at least one of a plurality of teeth of the first succession and a plurality of teeth of the second succession.

The term "providing" is used in a broad sense, and refers to, but is not limited to, making available for use, manufacturing, enabling usage, giving, supplying, obtaining, getting a hold of, acquiring, purchasing, selling, distributing, possessing, making ready for use, forming and/or obtaining intermediate product(s), and/or placing in a position ready for use.

In another aspect, the external body portion comprises at least one of eyebrows and eyelashes.

In a further aspect, the applying comprises applying the cosmetic product to at least eyelashes using at least a plurality of teeth of the first succession, and applying the cosmetic product to at least eyebrows using at least a plurality of teeth of the second succession.

In another aspect, the method further includes wiping excess cosmetic product from the applicator member.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate embodiments of the invention and, together with the description, serve to explain some of the principles of the invention.

In the drawings,

FIG. 12 is a view similar to FIG. 3 of a second embodiment of the applicator member;

FIG. 13 is a side view of the applicator member when viewed in the direction of arrow XIII of FIG. 12;

FIGS. 14 and 15 are cross-sections respectively taken along section lines XIV and XV of FIG. 13;

FIG. 16 is a detailed view of portion XVI of FIG. 12;

DETAILED DESCRIPTION OF EXEMPLARY EMBODIMENTS

Figure 1:
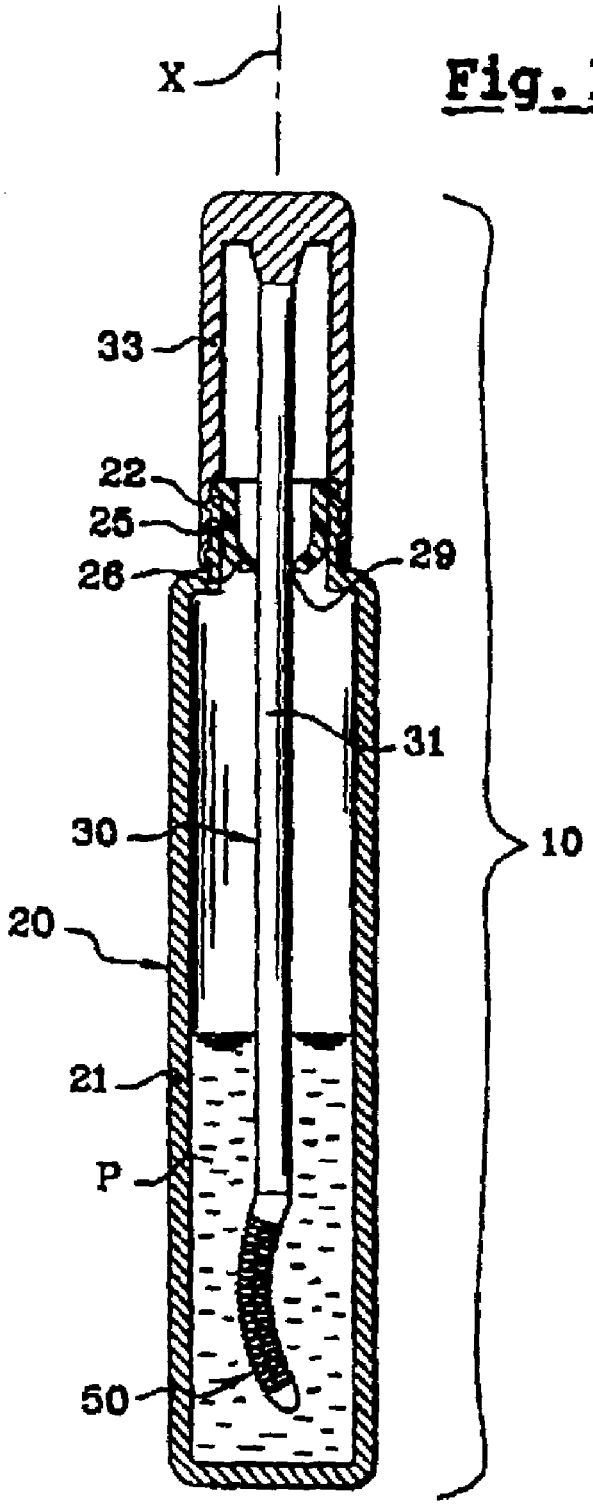
FIG. 1 is a partially schematic, diagrammatic view of a first embodiment of an applicator system.

Reference will now be made in detail to some possible embodiments of the invention, examples of which are illustrated in the accompanying drawings. Wherever possible, the same reference numbers are used in the drawings and the description to refer to the same or like parts.

FIG. 1 shows a first embodiment of an applicator system 10 of the present invention. The applicator system 10 comprises a receptacle 20 and an applicator 30.

The receptacle 20 comprises a body 21 containing a substance P, such as, for example, a cosmetic product for application to eyelashes and/or eyebrows. For example, the cosmetic product may be mascara. At the top of the receptacle 20, there is a neck 22, which may include an outside thread. The inside of the neck may have a wiper 25, which includes a flexible lip 26, fixed therein. The wiper 25 may be formed of an elastomer or any other suitable material.

Figure 8:
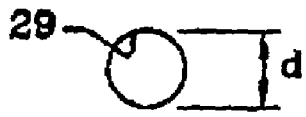
FIG. 8 is a schematic diagram of an inside edge of a wiper lip in the absence of the applicator.

In the example shown, in the absence of the applicator 30, a free inside edge 29 of the lip 26 may be circular, as shown in FIG. 8, and may define an opening having a diameter d. By way of example, the diameter d may be about 3 mm, for example, about 2.6 mm.

The applicator 30 may comprise a rod 31 having a circular cross-section. An applicator member 50 may be fitted to one end of the rod 31. At its other end, the rod 31 may extend from a handle element 33 that can also constitute a cap for closing the receptacle 20 in a leaktight manner. The handle element 33 may be configured to screw onto the threaded neck 22 in order to close the receptacle 20. It should be understood that the handle element 33 may be fixed onto the receptacle other than by being screwed thereon.

In the example shown, the rod 31 is rectilinear along an axis X which coincides with the axis of the neck 22 of the receptacle 20 when the applicator 30 is in place. It should be understood that the rod 31 may have a cross-section other than circular, for example, a flattened shape. The rod 31 may also extend in a manner that is not rectilinear, for example, forming a bend.

The rod 31 may have a diameter that is less than, greater than, or equal to the diameter of the opening defined by the lip 26 of the wiper. For example, the rod 31 may have a diameter that is greater than the diameter d, such as, a diameter equal to about 3.5 mm.

Figure 2:
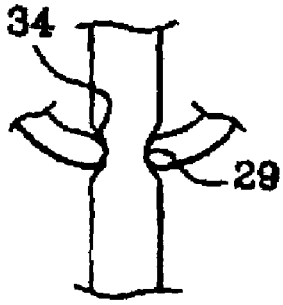
FIG. 2 is a fragmentary view showing a variant embodiment for the applicator rod of the system of FIG. 1.

In one embodiment, as shown in FIG. 2, the rod 31 may further include a narrowing 34 for positioning in register with the free edge 29 of the lip 26 when the applicator is in place. The narrowing 34 may serve to reduce the stresses applied by the rod 31 to the wiper 25 while the applicator is in place. For example, the narrowing 34 may present a diameter that is less than or equal to that of the opening defined by the free edge 29 of the lip 26 of the wiper 25.

Figure 3:
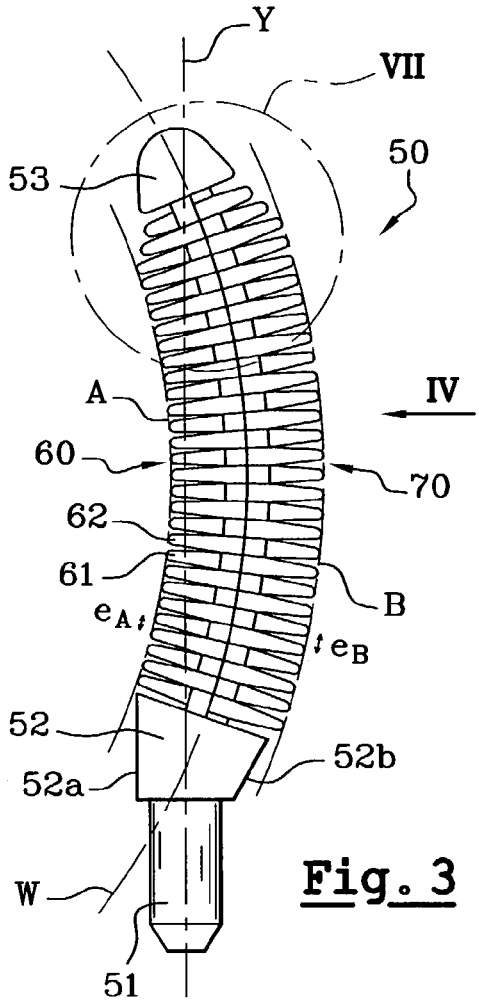
FIG. 3 is a side view of an applicator member of the system of FIG. 1.
Figure 6:
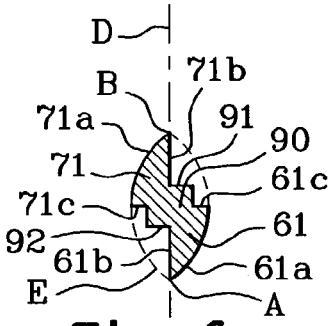
FIGS. 5 and 6 are cross-sections respectively taken along section lines V and VI of FIG. 4.
Figure 5:
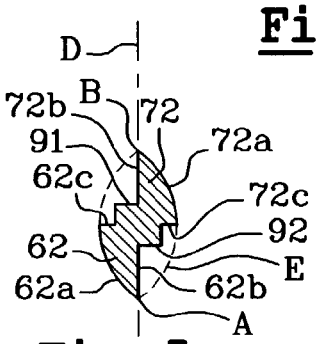

FIG. 3 shows the applicator member 50 on its own and on a larger scale. This applicator member 50 comprises an assembly portion 51 for being received in a housing provided at the bottom end of the rod 31 so as to enable the applicator element 50 to be assembled to the rod 31. The assembly portion 51 may be circularly cylindrical about an axis Y, for example. It may be connected to a proximal portion 52 of the applicator member 50. The applicator member 50 also has a distal portion 53 which is generally rounded in shape, for example, in order to make it easier to insert the applicator member 50 into the wiper 25. The proximal portion 52 may present a side 52*a* extending substantially parallel to the axis Y of the cylindrical portion 51 in order to lie substantially in line with the outside surface of the rod 31, and a side 52*b* at an acute angle with the axis Y and meeting the outside surface of the rod 31 without forming any significant step.

Between its proximal and distal portions 52 and 53, the applicator member 50 comprises an applicator portion made up of two successions (e.g., series) of teeth 60 and 70.

The first succession 60 comprises teeth 61 and 62 whose free ends lie substantially on a generally concave line A when the applicator element 50 is observed in a direction substantially perpendicular to the plane of FIG. 3.

The second succession 70 comprises teeth 71 and 72 whose free ends lie substantially on a generally outwardly convex line B when the applicator member 50 is observed in a direction substantially perpendicular to the plane of FIG. 3.

The applicator portion extends along a curvilinear longitudinal axis W which may or may not be entirely contained in a single plane. For example, the axis W may be contained in a plane that is parallel to the plane of FIG. 3. The axis W may have a substantially circular arc shape over at least a fraction of its length, or over the full length of the applicator portion. By way of example, the radius of curvature of the axis W may be about 30 mm. Alternatively, the radius of curvature may be greater than about 30 mm, for example, ranging from about 30 mm to about 32 mm.

Each of the teeth 61, 62, 71, and 72 extends along an axis Z and may be approximately triangular in shape in cross-section in a plane perpendicular to the axis W, the triangular shape having respective outwardly convex curvilinear outer sides 61*a*, 62*a*, 71*a*, and 72*a* connected to sides 61*b* and 61*c*,

62*b* and 62*c*, 71*b* and 71*c*, and 72*b* and 72*c*, respectively, that are rectilinear and substantially perpendicular.

The teeth 61, 62, 71, and 72 may be united by a generally central core 90 of substantially rectangular cross-section.

The envelope surface E of the applicator portion may present a cross-section that is generally lenticular, the outline defined by the curvilinear edges 61*a*, 62*a*, 71*a*, and 72*a* of this lenticular shape being elongate along a major axis D that is substantially parallel to the straight line joining the lines A and B.

Figure 7:
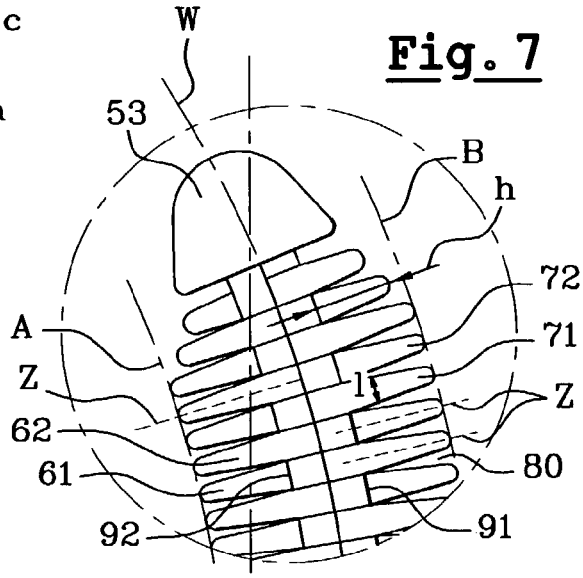
FIG. 7 is a detailed view of portion VII of FIG. 3.
Figure 10:
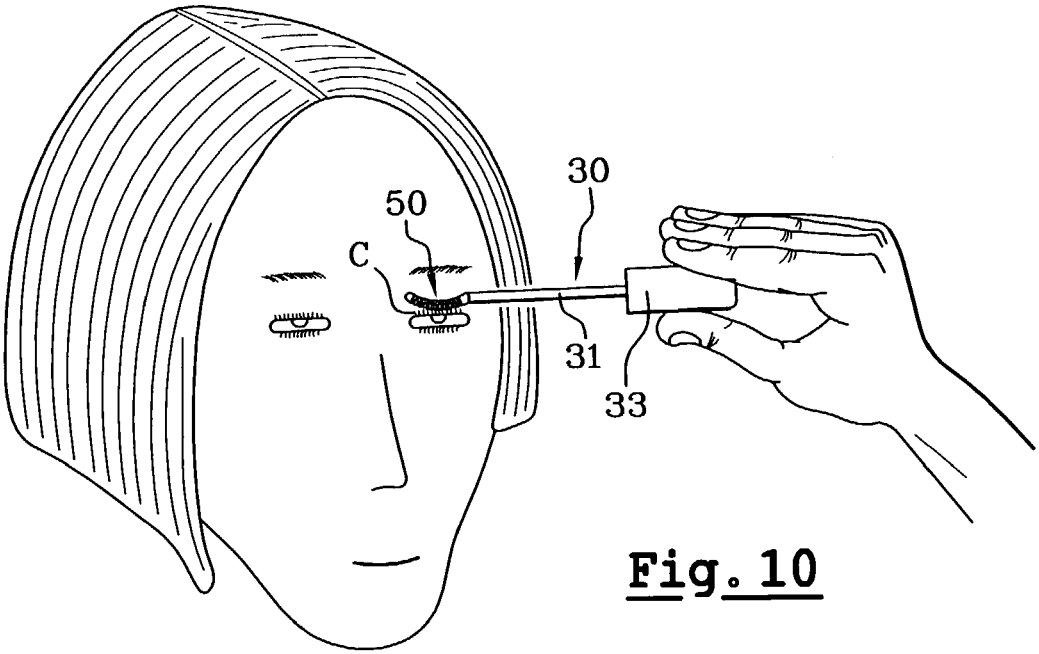
FIG. 10 shows an applicator embodiment in use for applying a cosmetic product (e.g., makeup) to the eyelashes.
Figure 11:
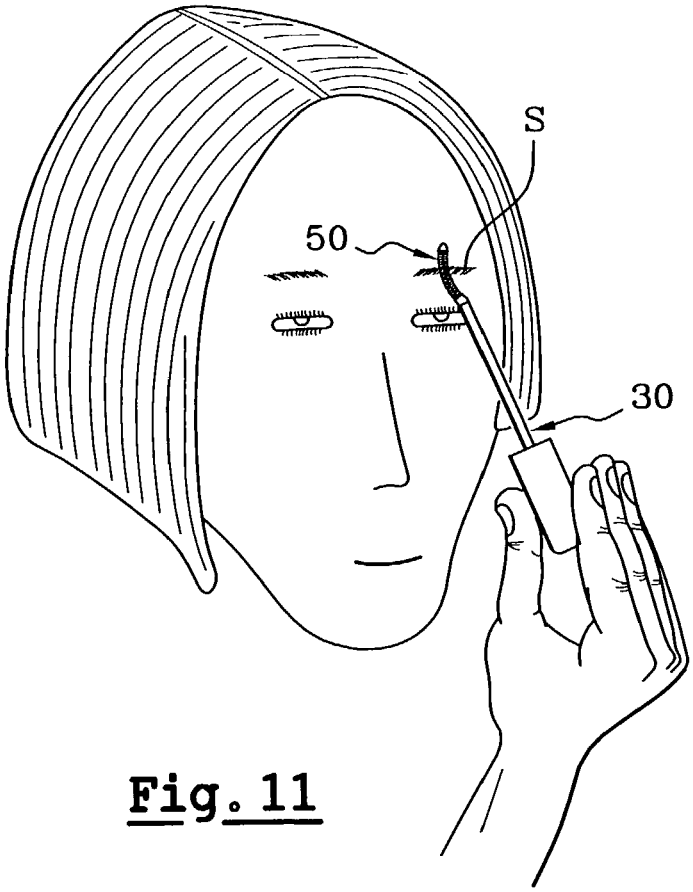
FIG. 11 shows an applicator embodiment in use for applying a cosmetic product (e.g., makeup) to the eyebrows.

From FIG. 7, it can be seen that the teeth closest to the distal portion 53 are of heights h measured along their respective axes Z and the heights h may decrease as the teeth approach the distal portion 53, thus making the applicator member 50 easier to insert into the wiper 25. In the example shown, the first two teeth of the successions 60 and 70 may present a height h that is less than that of the subsequent teeth which are of substantially constant height.

It may also be observed from FIG. 7 that the teeth 61, 62, 71, and 72 are all of width l measured parallel to the axis W. The width l may decreases on coming closer to their free ends, such that two consecutive teeth in any one series 60 or 70 form a groove 80 between them which is generally V-shaped, for example, when the applicator element is observed in a direction perpendicular to the plane of FIG. 3. The bottom of the V-shape may be situated substantially level with the edges 91 and 92 of the core 90 and the edge 91 may face towards the second succession 70 while the edge 92 faces towards the first succession 60.

The applicator member 50 may be made as a single piece by injection molding a non-elastomeric plastic material, although other materials may work as well.

The lines A and B may be substantially concentric, with the axes Z of the teeth extending as radii, although other arrangements may work equally well.

Figure 4:
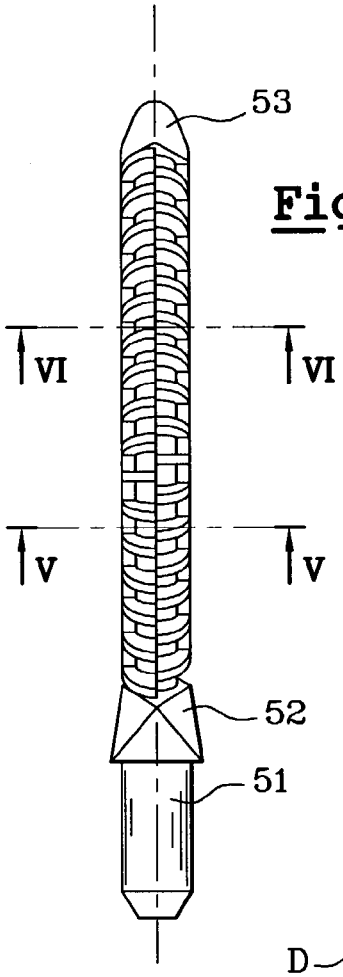
FIG. 4 is a side view of the applicator member when viewed in the direction of arrow IV in FIG. 3.

FIG. 4 shows that consecutive teeth in any given succession 60 or 70 may have their bases offset in a staggered configuration, thus enabling cavities to be created between the teeth suitable for being filled with substance.

One exemplary method of using the applicator system 10 will now be described.

Figure 9:
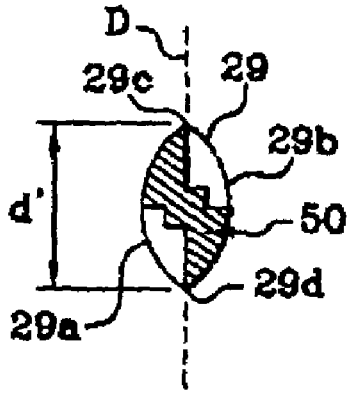
FIG. 9 is a schematic diagram of the inside edge of the wiper lip while the applicator member is placed therein.

The applicator 30 may be extracted from the receptacle 20 after the cap 33 has been unscrewed. The rod 31 and the applicator element 50 are wiped by the wiper 25. For example, the lip 26 of the wiper may deform on making contact with the applicator element 50, lengthening in the direction of the major axis D, as shown in FIG. 9, and pressing via opposite edges 29*a* and 29*b* against the sides of the applicator member. In the example of FIGS. 8 and 9, the distance d' between the ends 29*c* and 29*d* where the edges 29*a* and 29*b* meet is greater than the distance d. As a result, the elongation factor d'/d may be greater than or equal to about 1.5, greater than or equal to about 2, or even greater than or equal to about 2.5, thus making it possible to ensure that no excess substance is present in the gaps formed between three consecutive teeth in either succession 60 or 70.

In order to apply makeup to the eyelashes C, the user can make use of the concave side of the applicator member 50, i.e. the first succession 60 of teeth, by loading up the applicator member 50 with makeup and applying the makeup to the eyelashes by combing the eyelashes upwards going away from their bases towards their free ends. The user can use the convex side of the applicator member 50 for applying substance to the ends of the eyelid, in particular in the inside corner of the eye. Because the teeth may be relatively stiff, it may be possible to make use of formulas that dry relatively quickly, with the V-shaped grooves formed between the teeth serving to take hold of the lashes so as to smooth the substance onto their surfaces and so as to separate them.

After making up the eyelashes C, or possibly even without initially making up the eyelashes, the user can apply makeup to the eyebrows S by using the convex side of the applicator member 50, i.e. the second series 70 of teeth. It should be observed that because the teeth may be formed relatively stiff, they may not collapse on coming into contact with the skin, such that the core 90 of the applicator member does not come into contact with the skin. This may reduce the risk of any substance being applied to the skin.

Because the spacing $e_A$ between the free ends of two consecutive teeth in the first succession 60, as measured along the line A, is less than the spacing $e_B$ between the free ends of two consecutive teeth in the second succession 70, as measured along the line B, it may be possible, where appropriate, to wipe the convex side of the applicator member 50 to a greater extent than the concave side. The lip 26 may be capable of penetrating further between the teeth in the series 70 because of their greater spacing, thus removing more substance than from the concave side.

The applicator member can be made differently from that described above. For example, the disposition and the shape of the teeth can be modified without going beyond the ambit of the present invention.

By way of example, FIGS. 12 to 17 show a second embodiment of the applicator member 50' which differs from the above-described applicator member 50 in that the teeth 61 and 72 are replaced by teeth 61' and 72' that are united via their bases and that together form a half-moon-shaped cross-section, as can be seen in FIG. 14, and in that the teeth 62 and 71 are replaced by teeth 62' and 71' likewise united via their bases, and together forming a cross-section that is half-moon-shaped, as can be seen in FIG. 15. In the embodiment of FIGS. 3 to 7, the teeth situated on either side of a midplane containing the axis W belong in alternation to two succession 60 and 70 of teeth, whereas, in the applicator element 50' of FIG. 12, the teeth situated on either side of the midplane containing the axis W are formed by a succession of ribs each having a cross-section of half-moon-shape. The long sides of these ribs extend along radii centered on the center of curvature of the axis W.

It should be observed that as in the embodiment of FIGS. 3 to 7 described above, the spacing between the free ends of the teeth in the series 70' is greater than the spacing between the free ends of the teeth in the series 60'.

Figure 17:
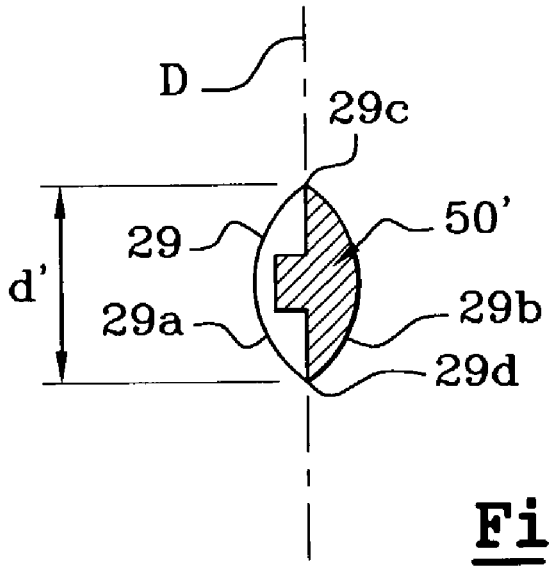
FIG. 17 is a schematic diagram of the inside edge of the wiper lip while the applicator member of FIG. 12 is passing therethrough.

In addition, as in the embodiment of FIGS. 3 to 7, on passing through the wiper, the wiping lip 26 is deformed as shown in FIG. 17, so that its edge 29 becomes oblong in the direction of the major axis D. In this configuration, the distance d' between the ends 29*c* and 29*d* may be greater than the diameter d by a factor that is greater than or equal to about 1.5, greater than or equal to about 2, or even greater than or equal to about 2.5. The distance d' between the ends 29*c* and 29*d* may lie in the range of from about 5 mm to about 10 mm, for example, being approximately 7 mm, whereas the diameter d is equal to about 2.6 mm, for example.

Figure 18:
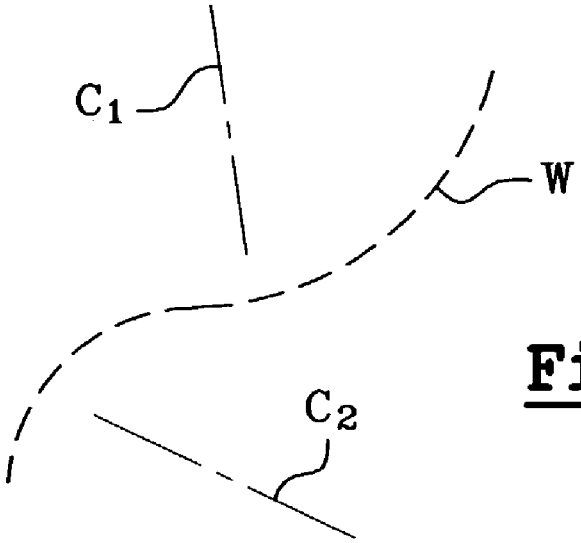
FIG. 18 is a schematic showing an alternative longitudinal axis of the applicator member that is not contained entirely in a single plane.

It is understood that the axis W may have other configurations. For example, the axis W may be contained in more than a single plane and it may be curved about at least two non-parallel axes of curvature. By way of example, as shown in FIG. 18, the axis W may extend so as to be curved over a fraction of its length about an axis C1 and over another fraction of its length about an axis C2, with the axis C2 being perpendicular to the axis C1, for example. The curvature of the axis W may make it possible to impart lateral oscillating motion to the applicator member by turning the applicator member about the axis of the rod 31, thus enhancing penetration of its teeth between the eyelashes and making it easier to take hold of them. The axes about which the applicator member is curved may intersect or they may lie in planes of symmetry for certain portions of the applicator member.

The applicator member can be made initially with a longitudinal axis that is rectilinear or curved, and it can subsequently be deformed while still hot about one or more axes of curvature. Alternatively, it can be made by molding thermoplastic material directly to have a longitudinal axis that is curvilinear. For example, the applicator member can be made as a single piece by molding a plastics material, such as, for example an elastomeric material. In addition, the applicator member can be made in other ways, such as, for example, by machining or stamping, using a plastics material or some other material, such as, for example, metals or composite materials.

The applicator member may have other projecting elements in addition to the teeth, such as, for example, bristles.

The applicator member, and more particularly the teeth, may include active substances, such as preservatives, moisture absorbers, metal salts, e.g. copper salts, for releasing when the applicator member is carrying makeup. These active substances may be mixed with the material used for making the applicator member or they may be deposited on the applicator member, or both techniques may be used. In addition, such a substance may be coated on the teeth and/or other portions of the applicator member, for example, in order to modify the surface tension of the applicator member.

The teeth and/or other portions of the applicator member may be coated with an agent for making them slide better over eyelashes, such as polytetrafluoroethylene (PTFE), or, in another variant, with a substance that increases friction.

The teeth situated on the convex or the concave side may have different shapes and/or different heights. For example, the teeth may be of a height h that varies depending on axial position along the axis W of the applicator member. For example, the height h may increase, decrease, decrease and then increase, or increase and then decrease, on going from one end of the applicator member to the other.

The teeth or other portions of the applicator member may have capillary grooves and/or flocking, for example, in order to increase the quantity of makeup that can be loaded onto the applicator element.

The teeth may be subjected to surface treatment, for example, by abrasion, in order to form forks at their ends, or by heat treatment, e.g. in order to round their ends, for example, to form beads at their ends.

Various materials can be used for making the teeth and the portion of the applicator element from which the teeth extend.

The applicator member and the applicator rod may be made as a single piece, for example, by molding a plastic material, or else, they may be made separately and then assembled together, both being made out of the same plastics material or out of different materials.

The length of a succession of teeth may lie in the range from about 15 mm to about 30 mm, for example, being about 25 mm.

The height of each tooth may lie in the range from about 2 mm to about 4 mm, for example, being about 3 mm.

The number of teeth in a succession may lie in the range from about 20 to about 40, for example, being about 30.

The applicator member may be used by being associated with a receptacle containing the substance for applying to the eyelashes and the eyebrows, the receptacle being provided with a wiper. Alternatively, the applicator may be used with a solid cake of substance, the applicator member being brought into contact with this solid cake of substance, e.g. after moistening the applicator and/or the cake. The applicator member may also be used after substance has been applied to the eyelashes by means of some other device, e.g. a mascara brush, with the applicator then being used, for example, to separate the eyelashes and to smooth out the substance on the surface thereof.

The free ends of a succession of teeth may optionally be offset from a midplane. In the examples of FIGS. 3 and 12, the free ends are situated substantially in a common midplane, but it would not go beyond the scope of the present invention for the free ends to be offset laterally from the midplane by a distance that is constant or otherwise.

In the foregoing description and in the following claims, unless otherwise indicated, it should be understood that the use term "a" does not necessarily signal that the term or terms following "a" are singular. For example, unless otherwise noted, the expression "comprising . . . a" should be construed the same as "comprising . . at least one."

As used in the present application, the term "parallel" includes the common meaning of the term (e.g., extending in the same direction, everywhere equidistant, and not meeting) and also includes a special meaning relating to where axes are coincident with one another.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. An applicator comprising:

an applicator member comprising an applicator portion, the applicator portion comprising a first succession of teeth and a second succession of teeth substantially opposite the first succession of teeth, wherein at least a plurality of the teeth of the first succession have free ends situated along a first line having a generally concave side facing away from the applicator portion, wherein at least a plurality of the teeth of the second succession have free ends situated along a second line having a generally convex side facing away from the applicator portion, and wherein the applicator portion defines an envelope surface, the envelope surface having, at at least one point along its length, a cross-section being generally elongate in shape and having a major axis substantially parallel to a straight line joining together the first line and the second line, the straight line being substantially perpendicular to the first line and the second line.

2. The applicator according to claim 1, wherein a spacing, measured along the first line, between the free ends of two consecutive teeth of the first succession is less than or equal to a spacing, measured along the second line, between the free ends of two consecutive teeth of the second succession.

3. The applicator according to claim 1, wherein the first and second lines are spaced apart by a distance having a maximum value ranging from about 5 mm to about 9 mm.

4. The applicator according to claim 1, wherein the first and second lines are spaced apart by a distance having a maximum value ranging from about 6 mm to about 8 mm.

5. The applicator according to claim 1, wherein the envelope surface of the applicator portion has a cross-section that is substantially lenticular at the at least one point along its length.

6. The applicator according to claim 1, wherein the applicator portion has a longitudinal axis contained entirely in a single plane.

7. The applicator according to claim 1, wherein the applicator portion has a longitudinal axis not contained entirely in a single plane.

8. The applicator according to claim 1, wherein the applicator member is made of a non-elastomeric plastic material.

9. The applicator according to claim 1, wherein a size of each of the teeth of at least one of the first succession and the second succession, as measured along a tooth axis, is greater than or equal to about 0.5 mm.

10. The applicator according to claim 9, wherein a size of each of the teeth of both the first succession and the second succession, as measured along a tooth axis, is greater than or equal to about 0.5 mm.

11. The applicator according to claim 1, wherein a size of each of the teeth of at least one of the first succession and the second succession, as measured along a tooth axis, is greater than or equal to about 1 mm.

12. The applicator according to claim 11, wherein a size of each of the teeth of both the first succession and the second succession, as measured along a tooth axis, is greater than or equal to about 1 mm.

13. The applicator according to claim 1, wherein a size of each of the teeth of at least one of the first succession and the second succession, as measured along a tooth axis, is greater than or equal to about 2 mm.

14. The applicator according to claim 13, wherein a size of each of the teeth of both the first succession and the second succession, as measured along a tooth axis, is greater than or equal to about 2 mm.

15. The applicator according to claim 1, wherein the applicator member is made of a plastic material having a hardness greater than or equal to about 60 on the Shore A scale.

16. The applicator according to claim 1, wherein the teeth of the first and second successions have axes that extend along radii projecting from a common center.

17. The applicator according to claim 1, wherein at least one tooth of the first succession and at least one associated tooth of the second succession have axes that are substantially parallel.

18. The applicator according to claim 1, wherein at least a plurality of teeth of at least one of the first succession and the second succession have bases disposed in a staggered configuration.

19. The applicator according to claim 18, wherein at least a plurality of teeth of both of the first succession and the second succession have bases disposed in a staggered configuration.

20. The applicator according to claim 1, wherein, when the applicator portion is observed from a side, at least some of the teeth form grooves that are V-shaped.

21. The applicator according to claim 1, wherein the length of the first succession ranges from about 15 mm to about 30 mm.

22. The applicator according to claim 1, wherein the length of the second succession ranges from about 15 mm to about 30 mm.

23. The applicator according to claim 1, wherein the height of the teeth of the first succession ranges from about 2 mm to about 4 mm.

24. The applicator according to claim 1, wherein the height of the teeth of the second succession ranges from about 2 mm to about 4 mm.

25. The applicator according to claim 1, wherein the number of teeth of the first succession ranges from about 20 to about 40.

26. The applicator according to claim 1, wherein the number of teeth of the second succession ranges from about 20 to about 40.

27. The applicator according to claim 1, wherein the applicator portion has a longitudinal axis having at least two curved portions and each of the at least two curved portions curve in differing directions.

28. The applicator according to claim 1, wherein the applicator portion includes a core having a substantially rectangular cross-section and each of the teeth of the first and second succession are formed on the core.

29. An applicator system comprising:

the applicator according to claim 1; and a receptacle configured to contain a substance to be applied by the applicator.

30. The system according to claim 29, further comprising a cosmetic product contained in the receptacle.

31. The system according to claim 29, wherein the cosmetic product is mascara.

32. The system according to claim 29, further comprising an elastically deformable wiper associated with the receptacle.

33. The system according to claim 32, wherein the wiper has an opening configured to allow the applicator member to pass therethrough while being withdrawn from the receptacle, the wiper being configured so that while the applicator member is passing through the wiper the opening changes shape by being lengthened in a direction substantially parallel to the major axis by an elongation factor that is greater than or equal to about 1.5.

34. The system according to claim 33, wherein, in the absence of the applicator member, the opening is substantially circular in shape.

35. The system according to claim 34, wherein the applicator comprises a rod having a substantially circular section, and wherein the applicator member is at an end of the rod and a diameter of the rod is greater than the diameter of the opening in the absence of the applicator.

36. The system according to claim 34, wherein, in the absence of the applicator, the opening has a diameter less than or equal to about 3 mm.

37. The system according to claim 33, wherein, in the absence of the applicator member, the diameter of the opening is less than or equal to a smallest cross-section of the envelope surface of the applicator portion.

38. The system according to claim 33, wherein the wiper has a wiper lip having a free end defining the opening.

39. The system according to claim 32, wherein the wiper has an opening configured to allow the applicator member to pass therethrough while being withdrawn from the receptacle, the wiper being configured so that while the applicator member is passing through the wiper the opening changes shape by being lengthened in a direction substantially parallel to the major axis by an elongation factor that is greater than or equal to about 2.

40. The system according to claim 32, wherein the wiper has an opening configured to allow the applicator member to pass therethrough while being withdrawn from the receptacle, the wiper being configured so that while the applicator member is passing through the wiper the opening changes shape by being lengthened in a direction substantially parallel to the major axis by an elongation factor that is greater than or equal to about 2.5.

41. The system according to claim 32, wherein the wiper is made of elastomer.

42. The system according to claim 41, wherein the wiper has a wiper lip having a free end defining an opening.

43. The system according to claim 32, wherein the applicator member has a proximal portion and a distal portion, the applicator portion being situated between the proximal portion and the distal portion, and the proximal and the distal portions being configured to make it easier to pass the applicator member through the wiper.

44. The system according to claim 29, wherein the applicator comprises a rod and an assembly portion to fix the applicator member to the rod.

45. The system according to claim 44, wherein the applicator member extends along a longitudinal axis of curvature such that a distal portion of the applicator member and a proximal portion of the applicator member are intersected by a straight line substantially parallel to a longitudinal axis of the assembly portion.

46. The system according to claim 29, wherein a size of each of the teeth of the first succession and the second succession, as measured along a tooth axis, decreases as the teeth of the first succession and the second succession near a distal portion of the applicator member.

47. A method of applying a cosmetic product, the method comprising:

providing the applicator according to claim 1;

loading a cosmetic product onto the applicator member; and applying the cosmetic product to at least one external body portion using at least one of a plurality of teeth of the first succession and a plurality of teeth of the second succession.

48. The method according to claim 47, wherein the external body portion comprises at least one of eyebrows and eyelashes.

49. The method according to claim 47, wherein the applying comprises applying the cosmetic product to at least eyelashes using at least a plurality of teeth of the first succession, and applying the cosmetic product to at least eyebrows using at least a plurality of teeth of the second succession.

50. The method according to claim 47, further comprising wiping excess cosmetic product from the applicator member.

51. The method according to claim 47, wherein the cosmetic product comprises makeup.

52. A method of applying a cosmetic product, the method comprising:

loading a cosmetic product onto an applicator member comprising an applicator portion, the applicator portion comprising a first succession of teeth and a second succession of teeth substantially opposite the first succession of teeth, wherein at least a plurality of the teeth of the first succession have free ends situated along a first line having a generally concave side facing away from the applicator portion, and wherein at least a plurality of the teeth of the second succession have free ends situated along a second line having a generally convex side facing away from the applicator portion;

applying the cosmetic product to at least eyelashes using at least a plurality of teeth of the first succession; and applying the cosmetic product to at least eyebrows using at least a plurality of teeth of the second succession.

53. The method according to claim 52, wherein the cosmetic product comprises makeup.

* * * * *

UNITED STATES PATENT AND TRADEMARK OFFICE

CERTIFICATE OF CORRECTION

PATENT NO. : 7,121,284 B2
APPLICATION NO. : 10/277670
DATED : October 17, 2006
INVENTOR(S) : Jean-Louis H. Gueret It is certified that error appears in the above-identified patent and that said Letters Patent is hereby corrected as shown below:

On the title page, item (57), line 12, "at least" should read --at at least--.

Signed and Sealed this

Twenty-third Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,121,284 B2
APPLICATION NO. : 10/277670
DATED : October 17, 2006
INVENTOR(S) : Jean-Louis H. Gueret It is certified that error appears in the above-identified patent and that said Letters Patent is hereby corrected as shown below:

On the title page, item (57), line 12, "at least" should read --at at least--.

Signed and Sealed this

Sixth Day of February, 2007

JON W. DUDAS
*Director of the United States Patent and Trademark Office*